United States Patent [19]

Knuppel et al.

[11] 3,950,161

[45] Apr. 13, 1976

[54] PROCESS FOR INCREASING THE LIFE OF BASIC REFRACTORY LININGS IN HEARTH-TYPE FURNACES

[75] Inventors: Helmut Knuppel; Karl Brotzmann; Hans-Georg Fassbinder, all of Sulzbach-Rosenberg, Germany

[73] Assignee: Eisenwerk-Gesellschaft Maximilianshutte mbH, Sulzbach-Rosenberg, Germany

[22] Filed: Aug. 2, 1974

[21] Appl. No.: 494,678

[30] Foreign Application Priority Data

Aug. 16, 1973 Germany ..... 2341424

[52] U.S. Cl. ..... 75/52; 75/59; 75/60

[51] Int. Cl.[2] ..... C21C 5/34

[58] Field of Search ..... 75/52, 59, 60, 95

[56] References Cited

UNITED STATES PATENTS

| | | | |
|---|---|---|---|
| 1,727,482 | 9/1929 | Moore | 75/95 |
| 3,771,998 | 11/1973 | Knuppel | 75/52 |
| 3,859,078 | 1/1975 | Haysom | 75/60 |

*Primary Examiner*—Peter D. Rosenberg

*Attorney, Agent, or Firm*—Lawrence I. Field

[57] ABSTRACT

An increase in the life of basic refractory linings in hearth type refining furnaces and a decrease in tap-to-tap time is achieved by the use of at least one refining tuyere which consists of two concentric pipes. The central pipe feeds oxygen into the melt below the bath surface, and a hydrocarbon stream surrounds the oxygen being fed into the bath, the hydrocarbon flowing in the space between the two pipes. Preferably the tuyere is embedded in the furnace backwall and is approximately horizontal and is directed toward the center of the hearth. By use of the double tuyere, oxygen can be used for refining without experiencing excessive refractory wear.

8 Claims, No Drawings

PROCESS FOR INCREASING THE LIFE OF BASIC REFRACTORY LININGS IN HEARTH-TYPE FURNACES

This invention relates to a process for increasing the life of basic refractory linings in hearth-type furnaces wherein oxygen and hydrocarbon(s) are introduced into the melt through one or more tuyeres consisting of coaxial pipes.

Refining pig iron to steel in convertor vessels wherein oxygen surrounded by gaseous or liquid hydrocarbons is introduced into the melt, entering the melt below the bath surface, preferably through the bottom of the convertor, is described in U.S. Pat. No. 3,706,549 issued Dec. 19, 1972, British Specification No. 1,264,539 further discloses how to load the oxygen with slagforming agents. In a typical process as presently practiced, the total refining time in a 200-ton convertor amounts to 10 minutes, 12 tons of lime being required for the process, such lime being added at the rate of about 4,000 kg/minute.

In addition to the oxygen refining processes described in the above patents (which are applied on a large scale in the steel industry at the present) a hearth-type refining process has recently become known, wherein oxygen surrounded by a protective medium is introduced into the melt below the bath surface. One particular advantage of this process consists in the appreciable reduction of refining time. For instance, when refining steel with oxygen surrounded by a protective medium in an open-hearth furnace in conformity with this process, refining times of 2–4 hours are obtained as compared with 6–8 hours in a conventional open-hearth.

In the recently described process, the oxygen is blown in through substantially horizontal tuyeres which are installed in the refractory masonry of the hearth-type furnace and which are below the bath surface. Ordinarily the tuyeres consist of at least two concentric pipes, oxygen being fed into the furnace hearth through the central pipe and a protective medium being fed through the annular space around the central pipe. Preferably this protective medium consists of liquid or gaseous hydrocarbons. The use of a protective medium substantially reduces wear of the tuyere pipes and of the refractory lining in the furnace hearth in the immediate vicinity of the tuyere.

When the new refining process is applied to an open-hearth furnace, the loading time and technique remain unchanged, but the refining time is shortened appreciably. Thus the tap-totap times with the new process are about 50% of the times previously obtained, even with the use of oxygen with top-blowing lances or for enrichment of combustion air.

However, the hearth refining process using oxygen tuyeres below the bath surface suffers from a serious drawback, namely the refractory lining has been found to wear more rapidly in a large area surrounding and especially above the tuyeres. Below, a detailed discussion will be found regarding the region in which this premature wear mostly takes place; to that end, an example involving a 250 ton open-hearth furnace is discussed.

A pair of tuyeres consisting of two concentric pipes was mounted on either side of the tap hole in the back wall of a 250 ton open-hearth furnace, the center pipe of the tuyeres supplied oxygen and was surrounded by a sheath of propane. The hearth masonry comprised walls of magnesite brick provided with a 5 mm thick protective layer of dolomite on the side of the hearth. After 10 melts, strong erosion was observed both above the tuyeres and alongside the tuyeres, extending as much as 2 meters from the tuyeres, in the region of the hearth back wall. Starting from the tuyere orifice, which was free of significant wear, there was increasing erosion of the tamped dolomite and almost complete erosion of the dolomite layer at the level of the slag line.

Using higher grade materials such as, for instance, low-iron magnesite improved life to 50 melts; however, this was unsatisfactory because it adversely affected the economy of the process. There was an increase in cost in consumption of refractory materials, and time was lost because of the required masonry repairs, thereby decreasing the availability of the hearth for operation.

Accordingly, the problem to which the present invention is addressed consists in eliminating the drawback of premature wear in the region around, and especially above, the tuyeres, while retaining the advantages of the new hearth refining process, wherein oxygen surrounded by hydrocarbons(s) is introduced in the melt below the bath surface.

According to the present invention, this problem is solved by loading the oxygen injected into the hearth with powder-like lime. Lime loading proved itself wear-reducing with respect to the refractory lining in the critical wall region above the tuyeres. Surprisingly, this premature wear of the hearth lining was completely eliminated by adding lime to the oxygen blown in through the tuyere, preferably at the beginning and at the end of the refining. By the practice of the invention it became possible to dispense with the use of special expensive refractory material.

While not wishing to be bound by any specific explanation, the following discussion is presented as one possibility.

Initially, the reason for the surprising increase in life of the basic lining of hearth-type furnaces when using lime dust in accordance with the invention was as unknown as the reason for the premature wear of the refractory lining in the wall area above the oxygen supply tuyeres.

The mode of discontinuous wear and the entire wear phenomenon gave no clear indication as to its cause. Because of the extent and the appearance of the erosion, washing off because of mechanical attacks due to the large flow rate of the melt was considered as likely as attacks by slag or melting due to excessive temperature.

Slag attack was unlikely because of the slagging practice in the new process had not been changed with respect to the conventional open-hearth process; and the same amount of lime or of limestone was added to the melt as in the conventional open-hearth process. The same amount of silicon, manganese, phosphorus and sulfur being refined from the melt, there was no reason for their oxide products producing more adverse slag compositions. Thus the amount of lime with respect to the silicon content of the steel melts corresponded to a lime/silica ratio of about four (4).

Observation and research during refining, to the extent possible during production conditions of a steel mill, led to the recognition that the silicon oxidation which occurs during oxygen introduction through the tuyeres below the bath surface was fundamentally different from the silicon oxidation which occurs in the conventional open-hearth process and that this might be the cause of the premature wear of the refractory lining. Quite possibly, the differences described below do take place in the process, so that the surprising effect of the addition of lime dust to the refining oxygen on the increase in life of the basic refractory lining may be explained as follows:

In the conventional open-hearth process, the bath motion is moderate because it is mainly due to CO generation during carbon oxidation. During definite phases of the process, the seething motion of the melt is particularly large for instance, when ore(s) and/or limestone are added in order to prevent undesirably high differences in concentration. Under these conditions, silicon slagging (to $SiO_2$) takes place sufficiently evenly over the entire hearth surface at the beginning of the oxidation phase. Therefore the slag forming oxides also are distributed fairly evenly through the entire slag layer, and strong local differences in concentrations are absent. The oxygen supplied to the melt (in comparison with direct gaseous oxygen feeding) takes place at a low rate and evenly above the slag phase and also opposes a locally preferential oxidation of the impurities in the pig iron.

The process mechanism is entirely different when pure oxygen is supplied to an open-hearth furnace below the bath surface through horizontally positioned tuyeres. First a physical pulse is imparted to the bath by the entering gas and hence a rotational motion is caused in the melt. Then a violent reaction takes place between the oxygen and the pig-iron-slag melt; the gaseous reaction products together with the gaseous protective medium cause a strong boiling motion in the region of the tuyere orifices. In this mechanism, the oxygen supply over the slag phase assumes only a minor role because the FeO content of the slag is definitely less than in the conventional open-hearth process.

The moment the oxygen is supplied below the bath surface, the silicon begins to be oxidized first and the $SiO_2$ so generated rises in the bath. There is a large increase of $SiO_2$, that is, there will be at least temporarily a local acid slag in the reaction space above the tuyere orifices, including the slag zone above, and this acid slag appears to cause the observed increased wear of the refractory lining. Because of the early formation of $SiO_2$, the slag layer above the tuyeres remains largely crumbly, that is, it is not yet liquefied; therefore this layer will not follow the rotary motion of the melt. Hence, there can be no decrease of the local excessive concentration of $SiO_2$.

The refractory masonry of nearly all hearth-type furnaces is basic and consists preferably of dolomite and magnesite. Acid masonries of silica, as were conventional in earlier days, are no longer utilized for open hearth furnaces because they cannot withstand the higher process temperatures.

The effect of an acid slag of a basic lining is known and may be discussed in simplified manner on the basis of the ternary $CaO$-$MgO$-$SiO_2$ system. The presence of other metal oxides such as FeO, MnO and $P_2O_5$ accelerates the slag attack because such oxides lead to the formation of reaction products which are liquid at lower temperatures. As regard to the attack of calcium silicate slags on magnesite, the $CaO/SiO_2$ ratio in the region of reaction is of primary significance. The moment this $CaO/SiO_2$ ratio in the region of reaction drops below 1.87, merwinite with an incongruent melting point of 1,575°C is stable along with dicalcium silicate; and the wear of the basic refractory materials thereby increases appreciably. For that reason, a high lime silica ratio of at least 2 is sought in practice.

With the above information the proportion of lime in the open-hearth furnace was increased to see if it would result in an increase in life of the critical masonry regions. With the increased lime, a lime/silica ratio of 4 was obtained, but it was found that even this increased proportion failed to improve the lining life in the critical region of the wall when oxygen was introduced through horizontal tuyeres located below the bath surface. Only when applying the teachings of the invention was it found possible to eliminate the premature wear of the refractory lining in the critical region of the wall and to provide some explanation for this result based on a possible mechanism of the Si-slagging.

With the present invention, then it became feasible to fully exploit in economical manner the new process, wherein the oxygen was fed into the melt below the surface of the bath via nearly horizontally installed tuyeres or tuyeres installed at a slight slope up to 20° with respect to the horizontal and in direction of the bath level. In the open-hearth furnace, for instance, the melting time could be reduced to one half, without additional loss of part of the gained time for subsequent lining repairs.

A specially advantageous application of the invention consists in blowing in a large fractional amount of dust-like lime at the very beginning of the oxygen supply, i.e., during the period when silicon slagging occurs. Thus, the blowing-in technique described below gave good refractory life. At the beginning of refining with oxygen, 3 kg of lime dust per standard cubic meter (STP) of oxygen, partly varying downward to about 1.5 kg of CaO per standard cubic meter (STP) of oxygen, were simultaneously blown in. The amount of lime dust must be adapted to the silicon content of the pig iron during this first blowing-in phase; at least 3 kg of lime dust must be added per 0.1% of silicon and per ton of pig iron.

It at the end of refining a further amount of lime dust is blown in together with the oxygen below the bath surface, a favorable metallurgical effect regarding the final contents of phosphorus and sulfur in the steel will also be achieved. The amounts of lime dust blown in may be of the same order of magnitude as at the beginning, that is, up to 5 kg of lime dust per standard cubic meter of oxygen.

The duration of the lime blowing-in period need not be limited either to the beginning or to the end of the refining process. In one suitable operation, the first lime blowing-in interval was about 25% of the total refining time, computed from the beginning of oxygen introduction, and that the second lime blowing-in interval at the end of refining also was about 25% of the total refining time.

The grain size of the lime utilized comprises commercially available grain sizes. Ordinarily about 90% of the lime weight proportion will be below grain sizes of 0.1 mm. It is advantageous to use this large proportion of fine grain so as to achieve a large reaction surface. Present day conventional lime grinding process provide a sufficient proportion of fine grains if the maximum grain size of the ground lime product is not larger than 2 mm.

It has also been found to be advantageous to add MgO carriers, i.e. compounds containing MgO especially dolomite or magnesite, to the lime dust, and up to a maximum proportion of 10% MgO in the mixture. By this means, the life of the entire hearth masonry was improved even for higher Si contents in pig iron. The moment proportions of Si in pig iron exceeded 1%, the lesser wear of the masonry experienced when adding MgO to the lime powder became noticeable.

The tuyeres utilized in the present process ordinarily consist of 2 or 3 concentric pipes, these are preferably mounted on both sides of the tap hole in the lower wall region. Installation is predominantly horizontal, however slight slopes of the tuyeres in direction of the bath level up to 30+ have also been found to be practical. The installation angle depends on the geometry of the hearth type furnace. Generally, small angles to the horizontal may be considered more advantageous if the hearth width is large. The tuyeres are installed at an angle to the axis of the tap hole, i.e., they are directed towards the center of the hearth. Installations perpendicular to the hearth wall, i.e., parallel to the tap hole, are less preferred. The angle between the tuyere pipes and the furnace backwall may be as high as 60°.

The following is a specific example of a preferred embodiment of the invention and is intended to illustrate, but not to limit the invention:

A 200 ton open-hearth furnace was charged in the usual way. After the addition of hot metal (pig iron) oxygen loaded with lime dust was blown into the melt below the bath surface from substantially horizontal tuyeres. Thereby the tap-to-tap time was reduced from 8 hours in the prior art open-hearth process to 4 hours in conformity with the process of this invention.

Approximately 70 tons of scrap are charged in the furnace in 1 hour and subsequently 150 tons of pig iron with 0.9% Si was poured into the furnace in 20 minutes. Following a short melting phase of 20 minutes, there begins the actual refining period of one hour, during which approximately 8,000 standard cubic meters of oxygen are fed through each of two pairs of tuyeres below the bath surface into the melt. The oxygen is loaded with 500 kg of lime dust per minute both during the first and the last 10 minutes of this refining phase.

Each of the tuyeres consisted of an oxygen pipe of stainless steel of 18 mm ID and of two concentric pipes of ordinary soft steel with a wall thickness of about 3 mm. The two annular spaces resulting therefrom each are 1 mm wide and are loaded with 3% by volume of propane referred to the amount of oxygen. Suitable stainless steel for the oxygen feed pipe are grades with more than 15% Cr, for instance a steel composed of 18% chromium, 1% molybdenum, 1% manganese, 1% silicon, 0.9% carbon, remainder iron.

Lime loading of the oxygen at the beginning of the refining period has provided two distinct advantages. Firstly, a lime/silica ratio of 2 was always obtained during desiliconization, and secondly the lime loading appeared to quiet the seething of the bath. In the absence of lime loading, there was violent splashing and seething motion in a large region of the melt above the tuyeres, with excessive refractory furnace lining wear. With lime loading, splash formation could be entirely suppressed. As regard to the 200 ton open-hearth furnace of the above example, the bath surface zone where the splash formation and pronounced seething motion could be observed amounted to about 10 square meters when lime loading was not used.

We claim:

1. In a process for increasing the life of basic refractory linings of hearth-type furnaces for steel production, wherein oxygen surrounded by hydrocarbon fluid is fed into a pig iron melt in said furnace below the surface of said melt by means of tuyeres consisting of two concentric pipes, the oxygen being blown in through the center pipe and the hydrocarbon being blown in through the space between said pipes;

the improvement which comprises:

feeding lime dust into the melt entrained in said oxygen, the amount of lime fed into the melt being at least 3 kg of lime dust per 0.1% of silicon in the melt and per ton of pig iron, and the lime being fed into the melt during desiliconization of the melt; wherein said lime is fed for at most 25% of refining time, from the beginning of refining of said melt.

2. A process as defined in claim 1 wherein the furnace has a back-wall and a taphole in said back-wall and the tuyeres through which the oxygen, lime and hydrocarbon are blown into the furnace are inclined with respect to the axis of said taphole.

3. A process as defined in claim 1, wherein the amount of lime entrained in the oxygen varies during the time of refining.

4. A process as defined in claim 1, wherein in addition a high load of lime is fed-in during the last phase of refining of no more than 25% of the total refining time.

5. A process as defined in claim 1, wherein the amount of lime in the oxygen is up to 5 kg of lime per standard cubic meter of oxygen.

6. A process as defined in claim 1, wherein an amount of an MgO containing compound up to 10% with respect to the total amount of lime is added to the lime and fed-in with the oxygen.

7. A process as defined in claim 2, wherein the oxygen is blown in horizontally and is directed into the furnace at an angle of up to 60° in the direction of the tap hole.

8. A process as defined by claim 2, wherein the oxygen is blown in deviating up to 20° from the horizontal in the direction of the bath level.

* * * * *